US007914093B2

(12) United States Patent
Huang

(10) Patent No.: US 7,914,093 B2
(45) Date of Patent: Mar. 29, 2011

(54) AUTOMATIC POSITION RESTORING SLIDE RAIL DEVICE

(75) Inventor: Kuo-Sheng Huang, Taipei County (TW)

(73) Assignee: Nan Juen International Co., Ltd., Taipei County (TW)

( * ) Notice: Subject to any disclaimer, the term of this patent is extended or adjusted under 35 U.S.C. 154(b) by 259 days.

(21) Appl. No.: 12/320,846

(22) Filed: Feb. 6, 2009

(65) Prior Publication Data

US 2010/0026152 A1 Feb. 4, 2010

(30) Foreign Application Priority Data

Jul. 30, 2008 (TW) ..... 97213502 U

(51) Int. Cl.
*A47B 88/04* (2006.01)

(52) U.S. Cl. ..... 312/333; 312/319.1

(58) Field of Classification Search ..... 312/294, 312/330.1, 333, 334.1, 334.8, 334.44, 334.47, 312/319.1; 384/21, 22
See application file for complete search history.

(56) References Cited

U.S. PATENT DOCUMENTS

| | | | | |
|---|---|---|---|---|
| 7,244,005 | B1 * | 7/2007 | Lu | 312/333 |
| 7,374,260 | B2 * | 5/2008 | Lu | 312/333 |
| 7,472,973 | B2 * | 1/2009 | Huang | 312/333 |
| 7,740,327 | B2 * | 6/2010 | Hsieh | 312/333 |
| 2008/0136300 | A1 * | 6/2008 | Wang | 312/319.1 |

* cited by examiner

*Primary Examiner* — James O Hansen
(74) *Attorney, Agent, or Firm* — Muncy, Geissler, Olds & Lowe, PLLC

(57) ABSTRACT

An automatic position restoring slide rail device includes: a slide rail device having a bottom rail and an inner rail slid with respect to the bottom rail; a control device having a control base, a spring connected between the control base and the slide cover, and a control plate with a concave guide slot, and the guide slot having a latch groove on one side and an aslant guide slot on another side, and the slide cover being covered at the control base, and having a first return slot and a second return slot; a swing element, including a first actuating block at the first return slot and a second actuating block at the second return slot, a link element, fixed at the inner rail. Therefore, the present invention can achieve a smoother and better automatic position restoration.

10 Claims, 8 Drawing Sheets

AUTOMATIC POSITION RESTORING SLIDE RAIL DEVICE

BACKGROUND OF THE INVENTION

1. Field of the Invention

The present invention generally relates to a slide rail device, and more particularly to an automatic position restoring slide rail device having the features of a simple structure, easy-to-manufacture and easy-to-assemble features, and a good operability to meet the cost-effective requirement of its manufacture and application.

2. Description of the Related Art

Pull cabinets or drawers are used extensively for containing and storing things or tools, and thus slide rails are generally installed on both sides of the cabinets or drawers to facilitate a stable operation of opening or closing operations of pulling, sliding or positioning the cabinets or drawers. To make it easier and more convenient for users to push and close the cabinets or drawers, the slide rails further integrate an automatic position restoring mechanism, such that if a user pushes the cabinet or drawer to an end section, the automatic position storing mechanism will draw the cabinet or drawer backward automatically by a pulling force and secure the cabinet or drawer at a closed position. With reference to FIG. 1 for an automatic position restoring technology of a conventional slide rail as disclosed in R.O.C. Pat. No. M287625, the slide rail comprises: a guide device, a guide slot disposed on a surface of a base, and composed of a linear portion and an arrowhead portion interconnected with a front end of the guide slot; a connecting device, comprising a slide element and a swing element pivotally coupled to the front of the connecting device, at least one guide tenon protruded from the bottom of the slide element and the swing element, and a bar-shaped guide column sheathed to the guide slot, and a hook slot disposed on a side of the swing element; a resilient element, with both ends coupled to the slide element and an object respectively; a hook bolt, including at least one latch gear protruded at a position corresponding to the hook slot of the swing element, for installing the guide device at an internal wall of an object, and installing the hook bolt at an external wall of another object in a corresponding direction, such that when the other object is pulled outward, the resilient element is extended, and if the guide column is in contact with an external edge of the arrowhead portion, the swing element is swung back and attached and fixed to an aslant wall of the arrowhead portion in a downwardly slanting position, such that the hook bolt is released from the latch of the swing element; if the other object is inserted, the latch gear of the hook bolt will be in contact with the internal wall of the hook slot at the swing element of the arrowhead portion and accommodated in the hook slot to release the latch, so that the resilient element is retreated to drive the connecting device and the hook bolt to restore their positions along the linear portion (as described in the patent specification of R.O.C. Pat. No. M287625). Although the aforementioned prior art can achieve the automatic position restoring function of the drawer, the resilient element is connected to the passive slide element, and the shock absorbing device for reducing shocks is also connected and operated actively with the passive slide element, and thus the resilient restoring function is weakened substantially, and the hydraulic cylinder type shock absorbing device is extended/contracted and operated at the passive slide element, and thus the shock absorbing device is worn out and damaged easily, and the shock absorbing device may cause a failure easily, so as to affect the life expectancy of the overall shock absorbing function adversely. Obviously, the foregoing prior art is not a good design. Due to the resilience and the shock absorbing force are the key points of the design of automatic position restoring drawers of this sort, the present technology uses a larger resilience to work with a passive shock absorbing structure to achieve the design, but such prior art is not applicable for the application of this structure, and also requires further improvements. Therefore, it is an important subject for related manufacturers and designers to overcome the shortcomings of the conventional automatic position restoring slide rails.

In view of the aforementioned shortcomings of the prior art, the inventor of the present invention based on years of experience in the related industry to conduct researches and experiments, and finally developed an automatic position restoring slide rail device with a smoother operation, a low cost and a durable feature in accordance with the present invention to overcome the shortcomings of the prior art.

SUMMARY OF THE INVENTION

Therefore, it is a primary objective of the present invention to provide an automatic position restoring slide rail device with smoother and better automatic position restoration, and the operation will not cause a failure easily and the invention comes with an easy-to-assemble feature, so as to improve the manufacturing cost and the cost-effectiveness for better practicability and competitiveness of the product.

To achieve the aforementioned objective, the technical measures taken by the invention comprises: a slide rail device, including a bottom rail and an inner rail slid with respect to the bottom rail; a control device, including a control base and a slide cover, and the control base being fixed to the bottom rail, and including a shock absorbing device and at least one spring, and the shock absorbing device including a dry rubber damping rod, and the spring being connected between the control base and the slide cover, and the control base having a control plate extended from the control base, and the control plate having a concave guide slot, and the rear side of the guide slot having a latch groove disposed on a lateral side of the guide slot and an aslant guide slot disposed on another lateral side of the latch groove, and the slide cover being slidably covered at the control base, and the slide cover having a shock absorbing joint pipe sheathed into a corresponding dry rubber damping rod, and the rear position of the slide cover having a first return slot at a front end and a second return slot at a rear end; a swing element, pivotally coupled into the slide cover, and including a front end with a first actuating block disposed in the first return slot, a rear end with a second actuating block disposed in the second return slot, and an embedding portion disposed at the bottom of the swing element and embedded into the guide slot; a link element, fixed at the inner rail, and a side of the link element having an arc press portion with a concave accommodating portion formed at a rear end of the arc press portion and a push-forward portion formed at the front end of the link element.

To make it easy for our examiner to understand the objects, technical characteristics and effects of the present invention, we use preferred embodiments and related drawings for the detailed description of the invention as follows:

DETAILED DESCRIPTION OF THE PREFERRED EMBODIMENTS

Figure 1:
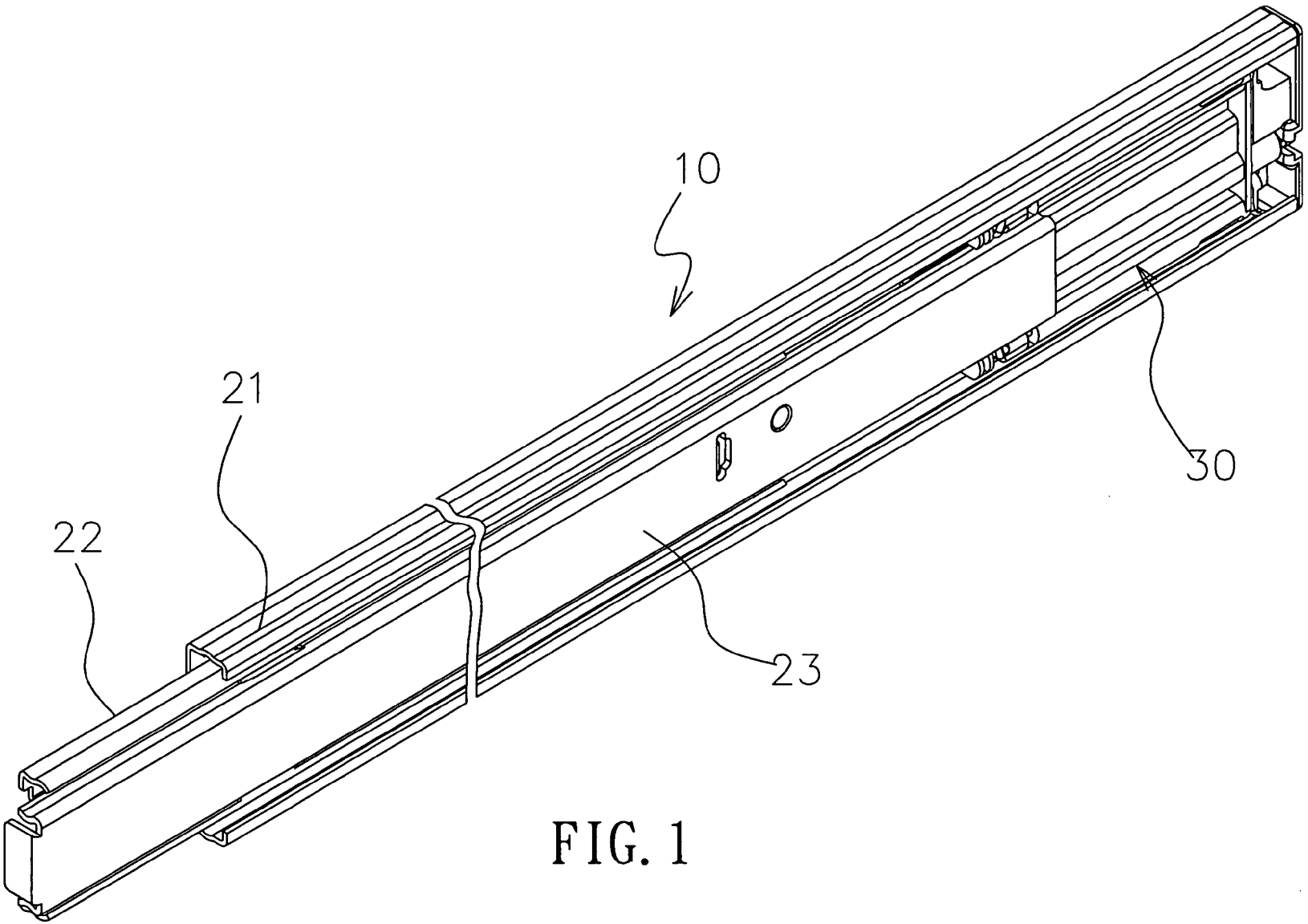
FIG. 1 is a perspective view of the present invention.
Figure 2:
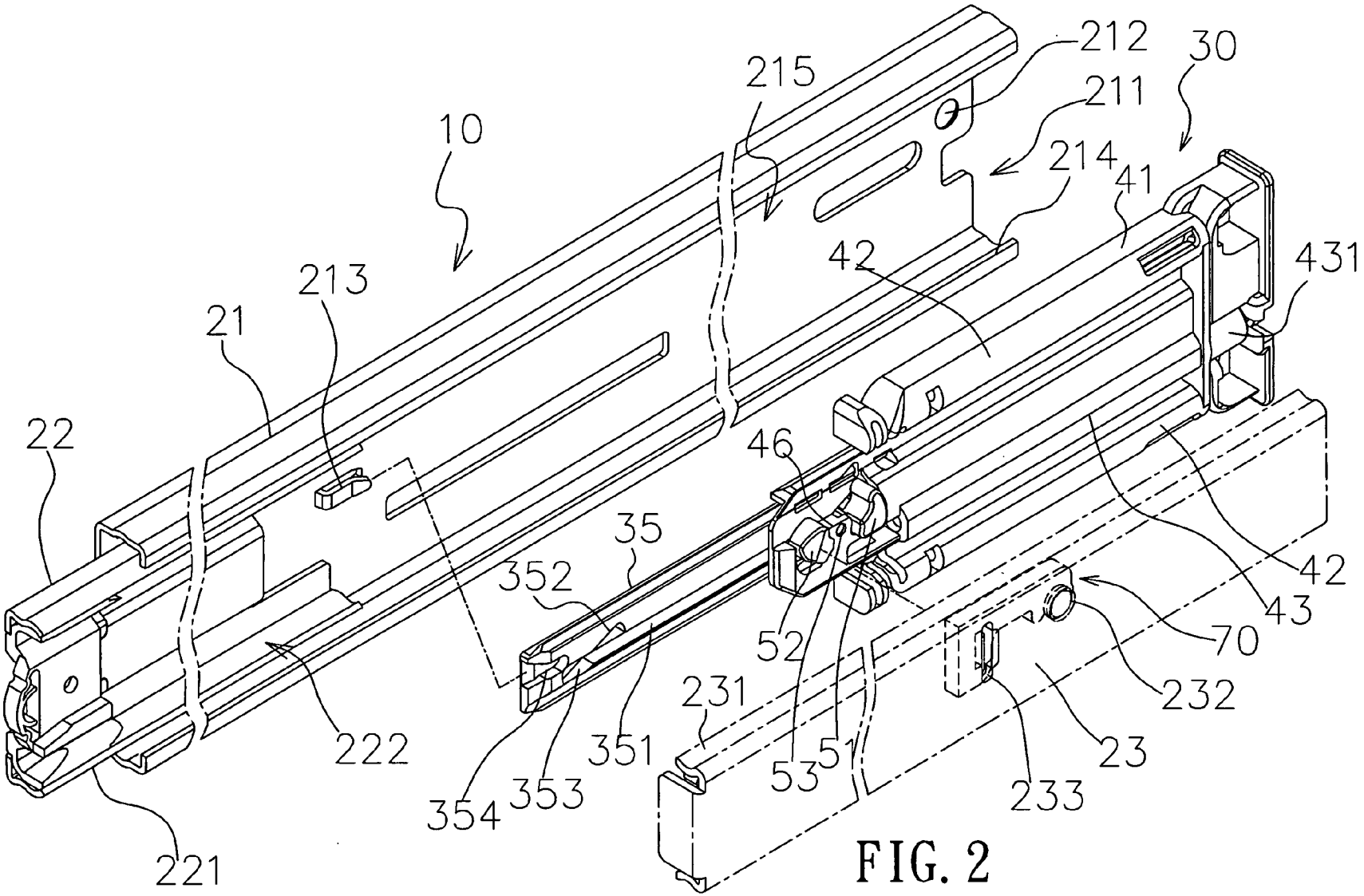
FIG. 2 is a partial exploded view of the present invention.
Figure 3:
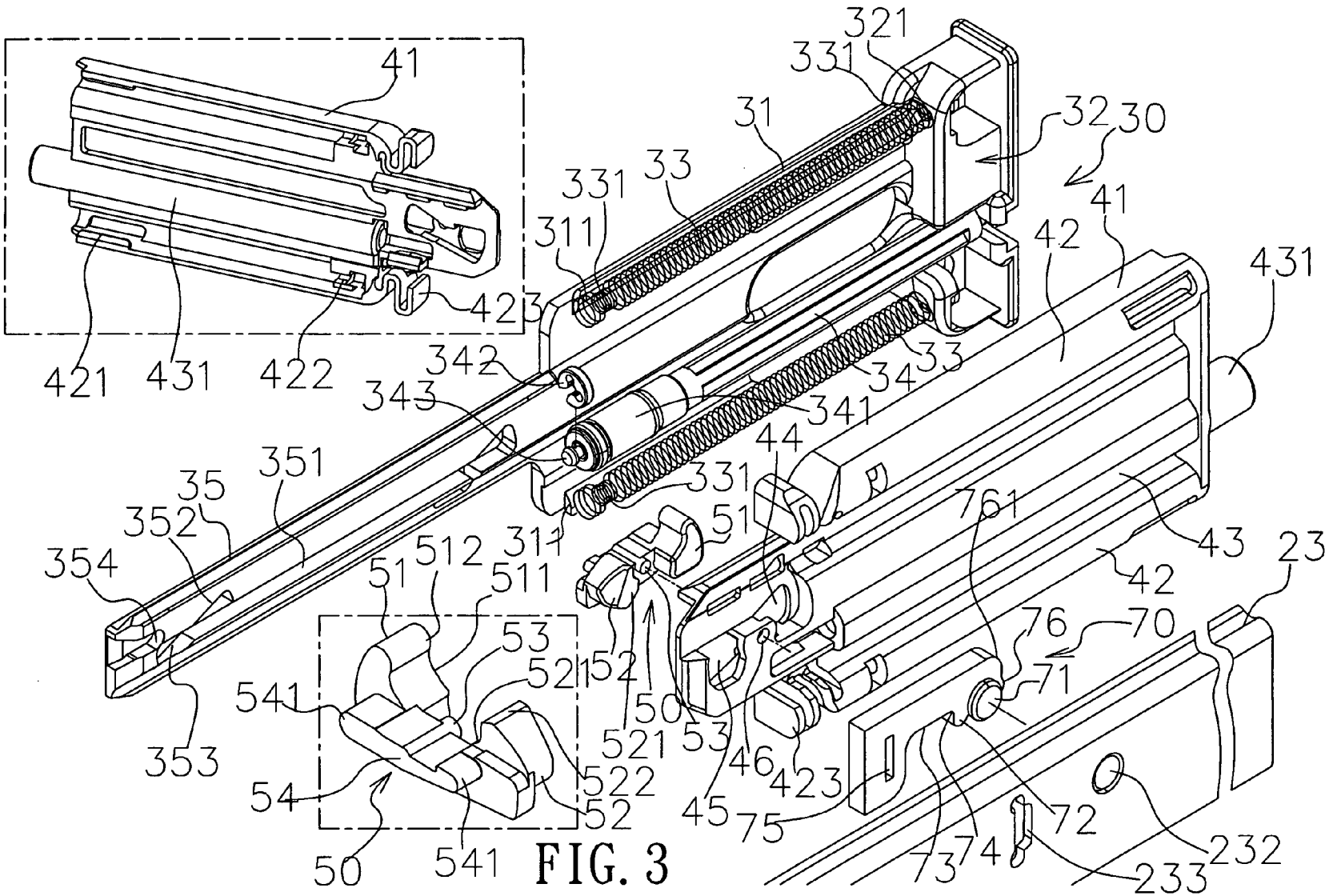
FIG. 3 is another partial exploded view of the present invention.

With reference to FIGS. 1 to 3 for an automatic position restoring slide rail device of the present invention, the automatic position restoring slide rail device comprises a slide rail device 10, a control device 30, a swing element 50 and a link element 70. The slide rail device 10 comprises a bottom rail 21, a middle rail 22 and inner rail 23, wherein the bottom rail 21 is fixed onto a cabinet (not shown in the figure), and the bottom rail 21 has a front end head portion 211 with a fixing hole 212 disposed at the front end head portion 211, and a positioning element 213 disposed at an appropriate position of the bottom rail 21, and a lateral protruding end 214 protruded separately from both sides of the bottom rail 21 for forming a bottom rail space 215, and the middle rail 22 is embedded and slid in the bottom rail space 215 of the bottom rail 21, and the middle rail 22 has a lateral protruding end 221 protruded separately from both sides for forming a middle rail space 222, and the inner rail 23 is fixed to a drawer or cabinet (not shown in the figure) and embedded and slid in the middle rail space 222 of the middle rail 22, and the inner rail 23 has a lateral protruding end 231 protruded from both sides of the inner rail 23 in a direction corresponding to the middle rail 22 and a positioning hole 232 and an adjusting hole 233 disposed at appropriate positions of the inner rail 23.

The control device 30 includes a control base 31 and a slide cover 41, and the control base 31 includes a press plate 311 disposed on both sides of the control base 31 and a distal base portion 32 disposed at a front end of control base 31 and fixed to the front end head portion 211 of the bottom rail 21 through the fixing hole 212 (by screws), such that the control device 30 is fixed into the bottom rail space 215, and the control base 31 includes a spring 33 disposed separately on both sides of the control base and a shock absorbing device 34 disposed between the springs 33, and the spring 33 is fixed to an embedded clamp opening 321 of the distal base portion 32 by a retreating portion 331 at its front end, and the rear end of the shock absorbing device 34 includes a dry rubber damping rod 341 fixed onto an axle rod 343 by a C-ring 342, and the control base 31 includes a control plate 35 extended backward, and the control plate 35 has a concave guide slot 351, a latch groove 352 disposed at a rear position of the guide slot 35 and a guide slot 353 disposed at a rear end of the latch groove 352, and both latch groove 352 and aslant guide slot 353 are disposed on both sides of the guide slot 351 respectively, and an abutting groove 354 is disposed at a rear end of the control plate 35.

The slide cover 41 is slidably covered at the control base 31, and the slide cover 41 has a spring slot protecting portion 42 and a shock absorbing slot protecting portion 43 disposed on both sides of the slide cover 41 for protecting the spring 33 and the shock absorbing device 34 respectively, and the spring slot protecting portion 42 has a side press 421 on an internal side of the front end and a latch retreating portion 422 at the rear end, and the side press 421 is abutted against the press plate 311 of the control base 31, such that the slide cover 41 will not fall off when the control base 31 slides, and the latch retreating portion 422 is provided for coupling the retreating portion 331 at the rear end of the spring 33. In other words, the spring 33 is connected between the control base 31 and the slide cover 41, and the spring slot protecting portion 42 has a resilient press portion 423 disposed at a rear end of the spring slot protecting portion 42 for producing a resilient shock absorption. The shock absorbing slot protecting portion 43 has a shock absorbing joint pipe 431, and the shock absorbing joint pipe 431 has a front end protruded from the shock absorbing slot protecting portion 43, and the shock absorbing joint pipe 431 is sheathed onto the dry rubber damping rod 341 for primarily restricting the resilient shock absorption. The rear of the slide cover 41 has a first return slot 44 disposed at a front end of the slide cover 41 and a second return slot 45 and the first return slot 44 disposed at a rear end of the slide cover 41. A pivoting hole 46 is disposed between the first return slot 44 and the second return slot 45, and installed at the front and rear on both sides of the pivoting hole 46.

The swing element 50 is installed in the slide cover 41 of the control device 30, and the swing element 50 includes a first actuating block 51 and a second actuating block 52 at the front end, and a pivotal rod portion 53 disposed between the first actuating block 51 and the second actuating block 52, wherein the first actuating block 51 has a first concave press portion 511 at its rear end and a first distal arc portion 512 at its lateral side, and the second actuating block 52 has a second concave press portion 521 at its front end and a second distal arc portion 522 at its lateral side. The swing element 50 has a bar-shaped embedding portion 54 disposed below, and the front and rear ends of the embedding portion 54 have an arc end 541. When the swing element 50 is assembled, the pivotal rod portion 53 is pivotally coupled to the pivoting hole 46 of the slide cover 41, such that the first actuating block 51 is inserted and fixed into the first return slot 44, and the second actuating block 52 is inserted and fixed into the second return slot 45, and the embedding portion 54 is embedded into the guide slot 351 of the control plate 35, such that when the swing element 50 slides in the guide slot 351 through the embedding portion, the swing element 50 drives the slide cover 41 to move through the pulling of the first actuating block 51 coupled to the first return slot 44.

The link element 70 is substantially an L-shaped rod having a protruding axle portion 71 at its front end and an arc press portion 72 disposed at a rear end of the protruding axle portion 71, and the arc press portion 72 forms an angular recession 74 at an internal side and a concave accommodating portion 73 formed at a lateral side, and the link element 70 has an adjusting slot 75 disposed at the rear position corresponding to the adjusting hole 233 of the inner rail 23. In addition, the front end of the protruding axle portion 71 has a front protrusion 76, and the front protrusion 76 forms a push-forward portion 761 on a lateral side of the front protrusion 76. The link element 70 is fixed to the positioning hole 232 of the inner rail 23 through the protruding axle portion 71, such that the link element 70 and the inner rail 23 are linked integrally, wherein appropriate press elements (not shown in the figure) can be installed at the adjusting hole 233 of the inner rail 23 and the adjusting slot 75 of the link element 70 for controlling the fixing or actuating state of the arc press portion 72.

Figure 4:
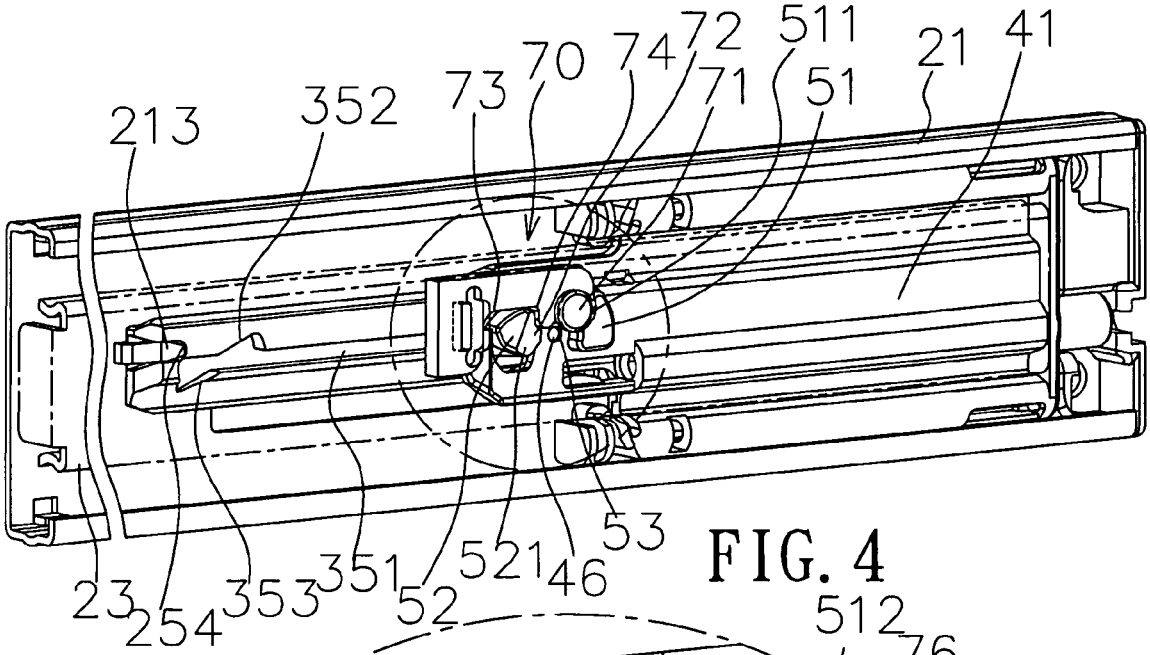
FIG. 4 is a first schematic view of an operation of pulling a structure according to the present invention.
Figure 4A:
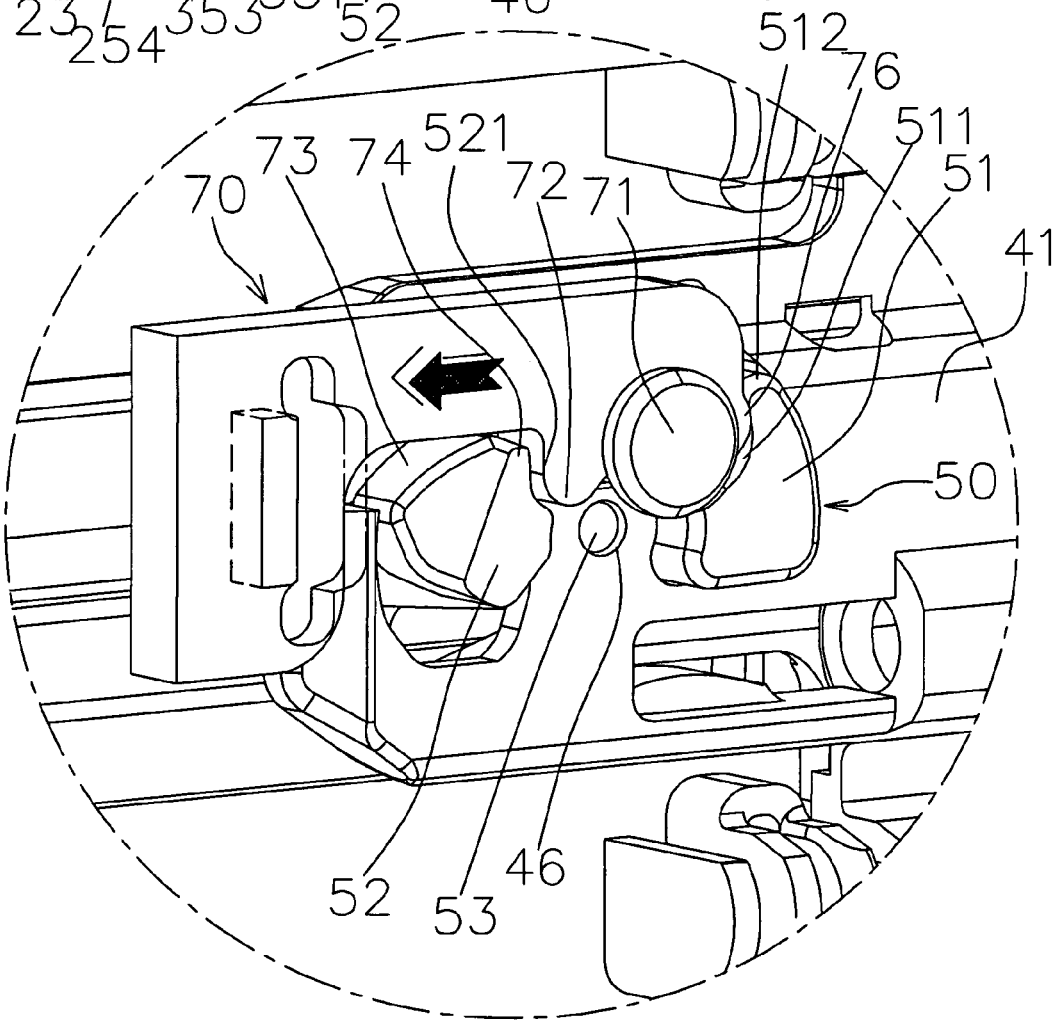
FIG. 4A is a partial enlarged view of FIG. 4.
Figure 5:
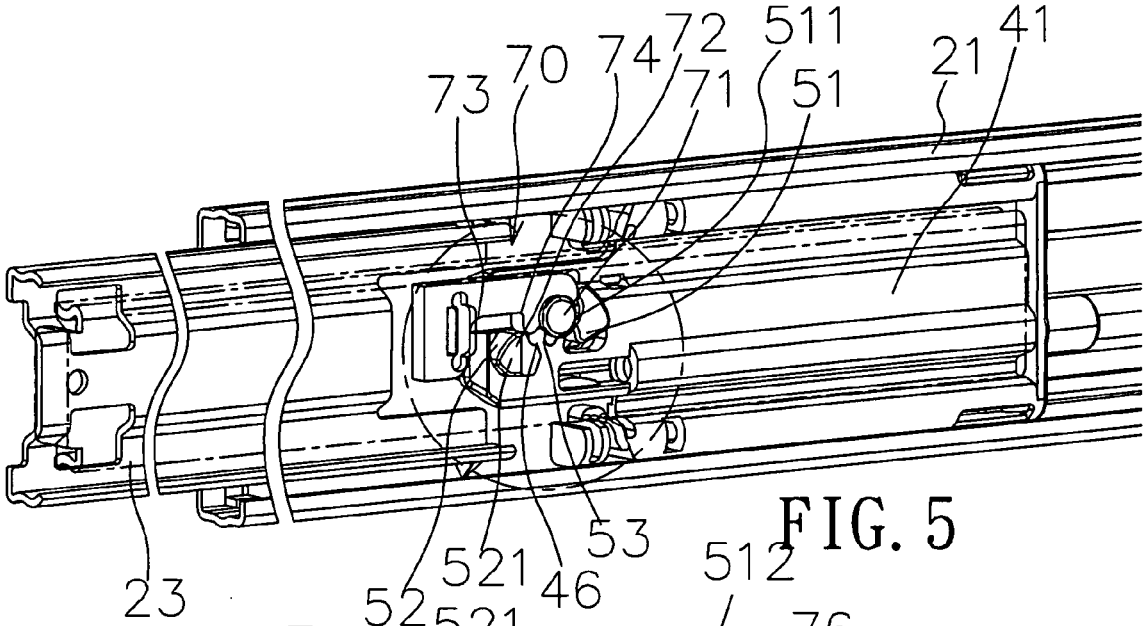
FIG. 5 is a second schematic view of an operation of pulling a structure according to the present invention.
Figure 5A:
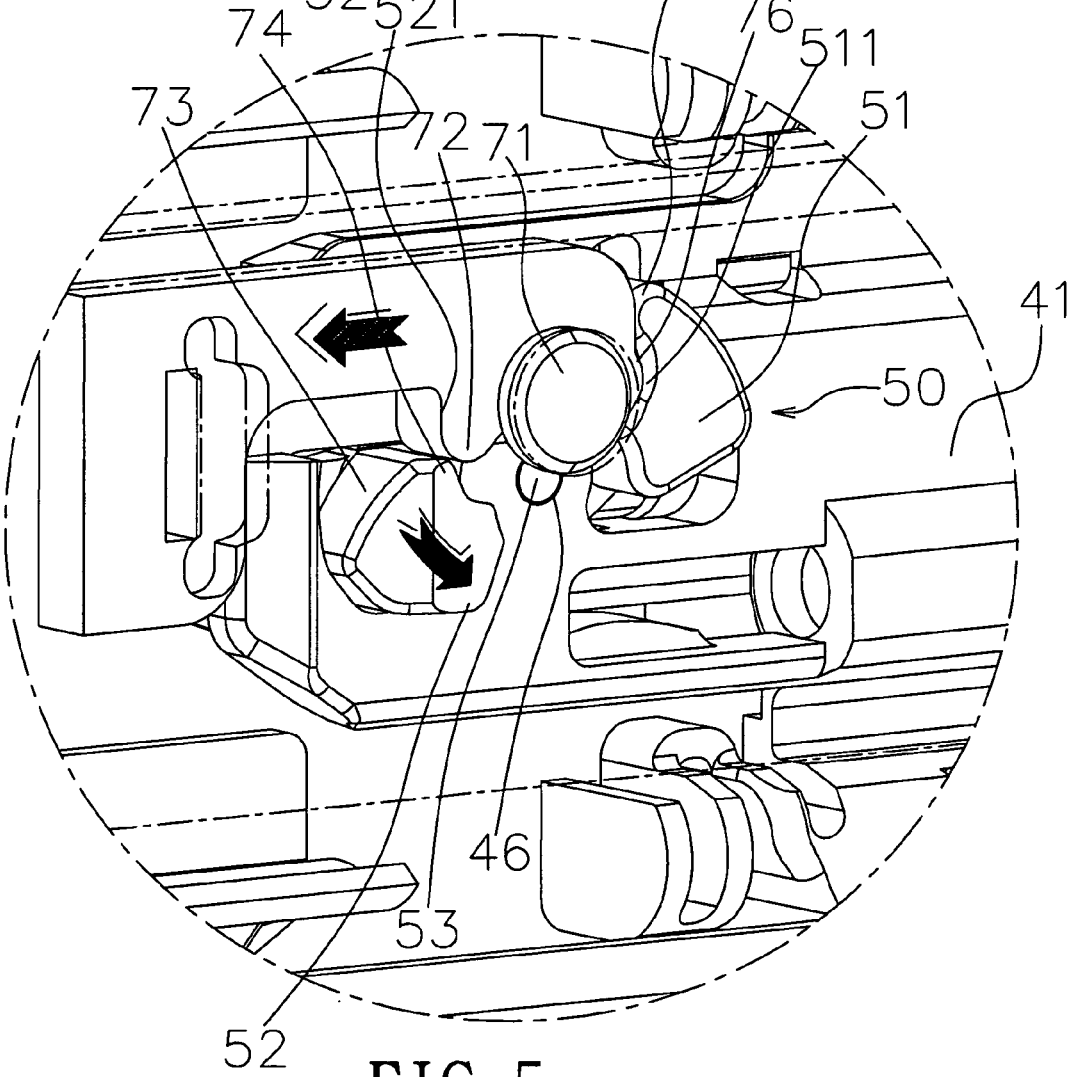
FIG. 5A is a partial enlarged view of FIG. 5.

When the automatic position restoring slide rail device of the invention is assembled, the bottom rail 21 is engaged with the middle rail 22, and the middle rail 22 is engaged with the inner rail 23 to constitute a state of sliding with each other, wherein the middle rail 22 is pressed and coupled to a resilient press portion 423 of the slide cover 41. The swing element 50 is movably situated at the guide slot 351 of the control device 30, so that the second actuating block 52 drops to a lateral concave accommodating portion 73 of the link element 70, and the second concave press portion 521 of the second actuating block 52 is hooked by the arc press portion 72 of the link element 70 (as shown in FIGS. 4 and 4A), such that the link element 70 has a link force for pulling the swing element 50.

With reference to FIGS. 4, 4A, 5 and 5A, if a drawer or a cabinet is pulled, the inner rail 23 (coupled to the drawer or the cabinet) will be slid backward to drive the link element 70 to move, and the link element 70 continues pulling the second actuating block 52 of the swing element 50 by the arc press portion 72, so as to drive the swing element 50 to move together, and then uses the swing element 50 to link the slide cover 41, so that the slide cover 41 is moved with respect to the control base 31 (or the guide slot 351). Now, the swing element 50 is restricted by the guide slot 351, and thus the spring 33 is gradually situated at an extended state.

Figure 6:
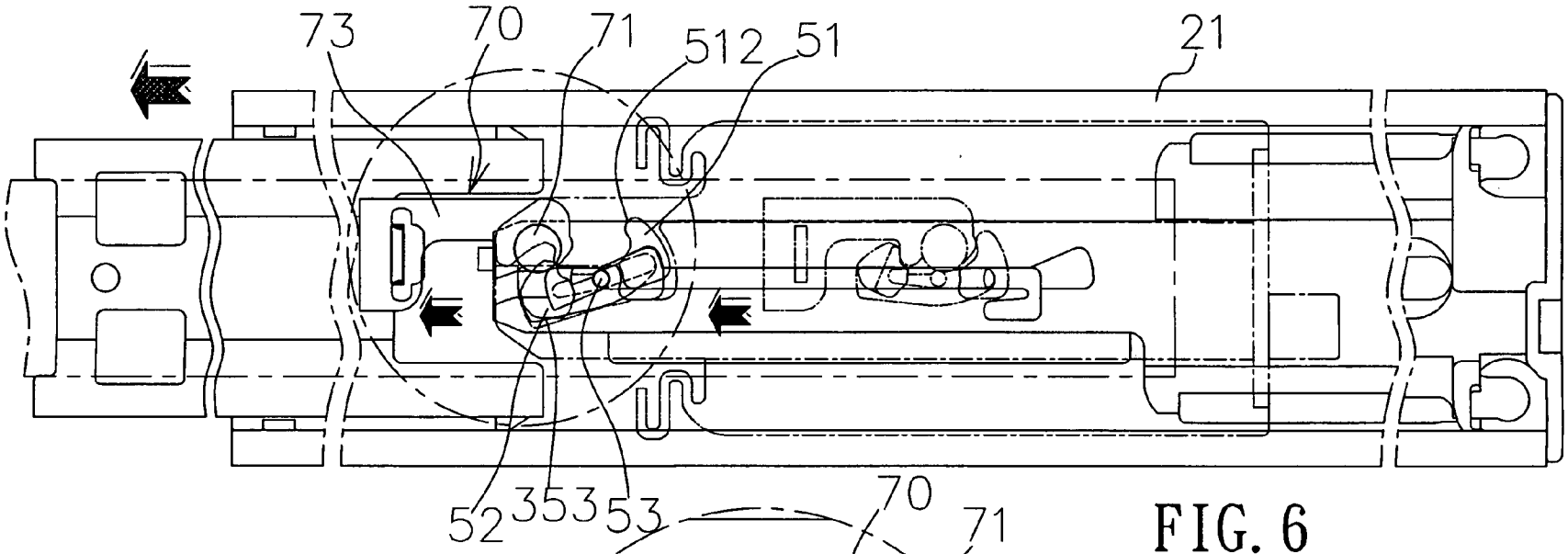
FIG. 6 is a third schematic view of an operation of pulling a structure of the present invention.
Figure 6A:
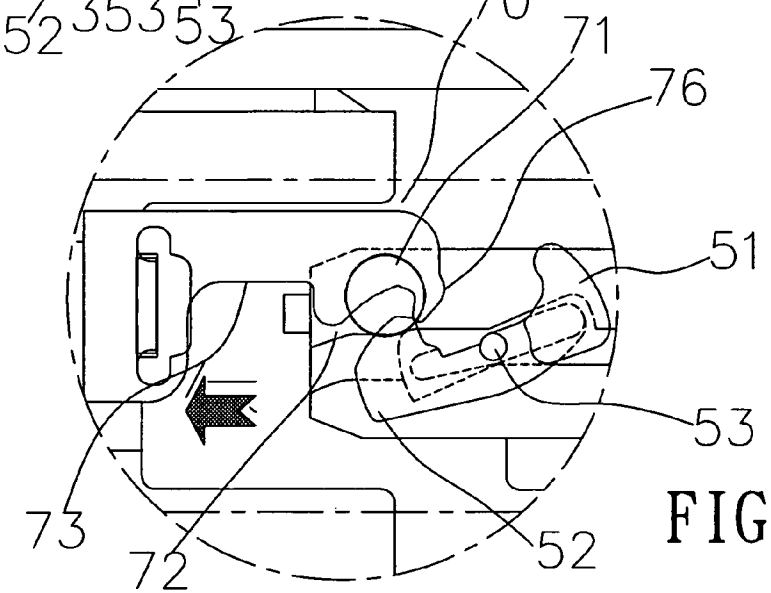
FIG. 6A is a partial enlarged view of FIG. 6.

With reference to FIGS. 6 and 6A, if the inner rail 23 and the link element 70 keep moving backward to pull the swing element 50 to the positions of the latch groove 352 and the aslant guide slot 353 of the control plate 35, the second actuating block 52 of the swing element 50 will be guided and pushed towards another side of the aslant guide slot 353 by the pulling force of the link element 70. In other words, the swing element 50 will be turned and swung according to the pivotal rod portion 53, and the first actuating block 51 is swung into the latch groove 352 of the control plate 35. Since the swing element 50 has a space (the latch groove 352 and the aslant guide slot 353) for the swing movement, so that the link element 70 can keep pulling the swing element 50 to separate the second actuating block 52 from the link element 70 (or the arc press portion 72). In other words, the link element 70 will pass across the swing element 50, and the link element 70 is separated from the swing element 50 to move the inner rail 23 and the link element 70 with the operation of pulling the drawer or the cabinet, so as to complete the operating of opening the drawer or the cabinet. The swing element 50 applies a pulling force of the spring 33 to the slide cover 41, so that a latch is constituted after the first distal arc portion 512 of the first actuating block 51 is embedded into the latch groove 352, while maintaining the slide cover 41 at a temporary fixed state, and the spring 33 is situated at a final extended state.

In the aforementioned operation of pulling the drawer or the cabinet, the inner rail 23 is slid and extended on the middle rail 22, such that when the slide cover 41 is moved, the middle rail 22 is also pushed by the slide cover 41, and the inner rail 23 is driven to slide and extend until the drawer or the cabinet is pulled open.

Figure 7:
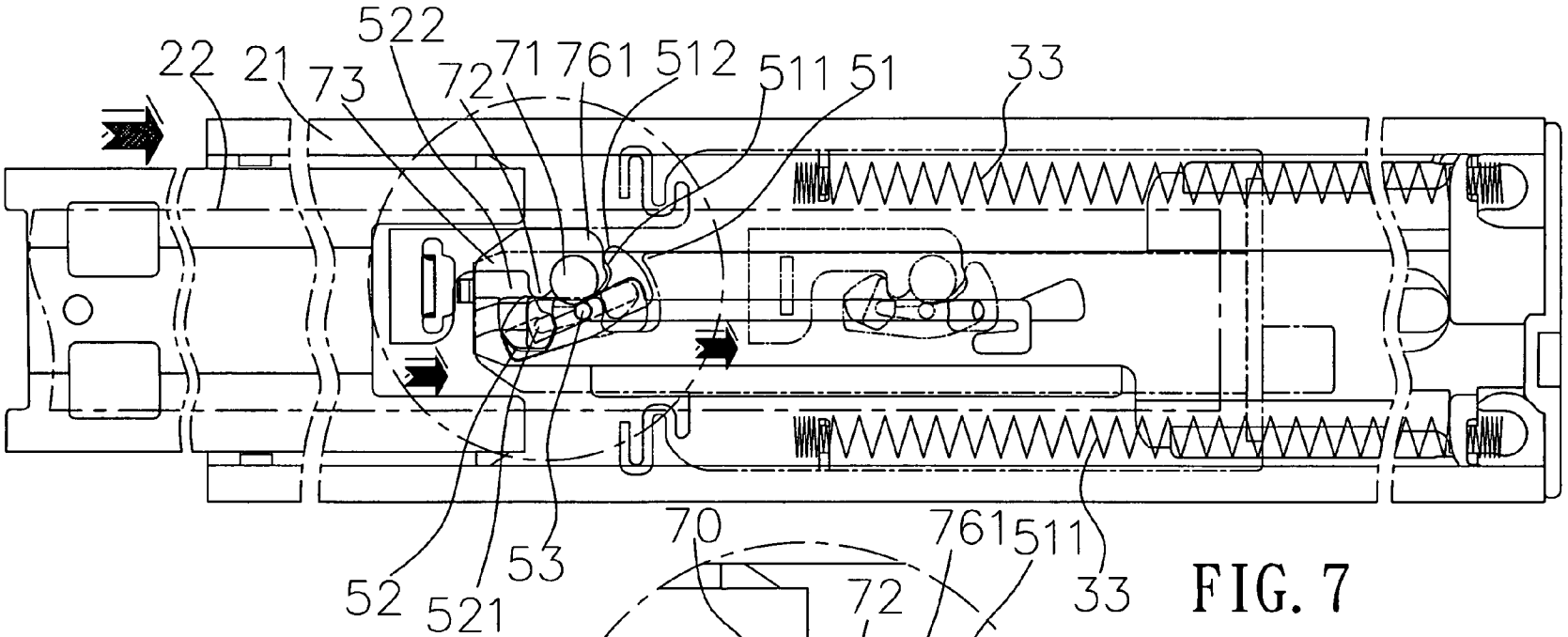
FIG. 7 is a schematic view of completing an operation of pulling a structure of the present invention.
Figure 7A:
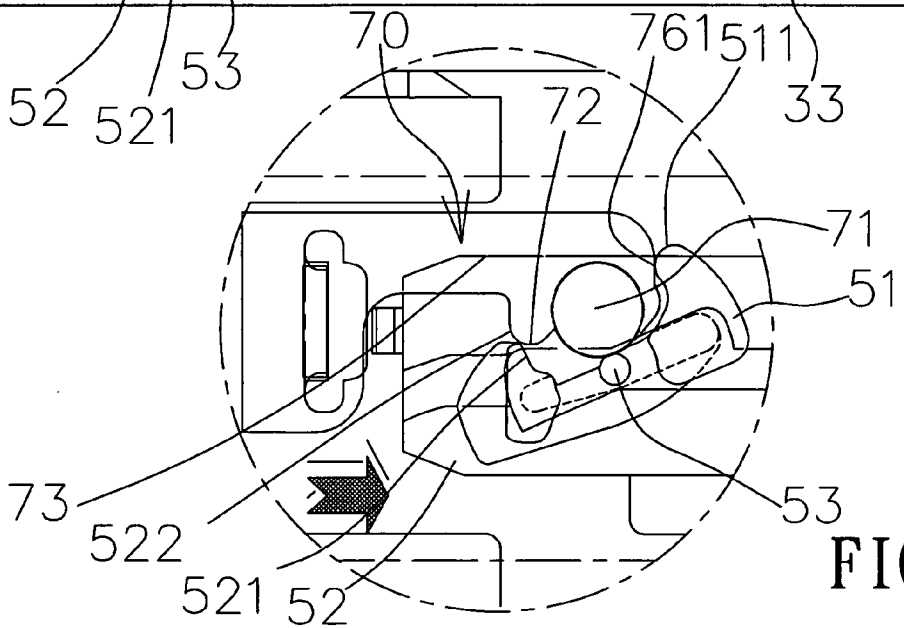
FIG. 7A is a partial enlarged view of FIG. 7.
Figure 8:
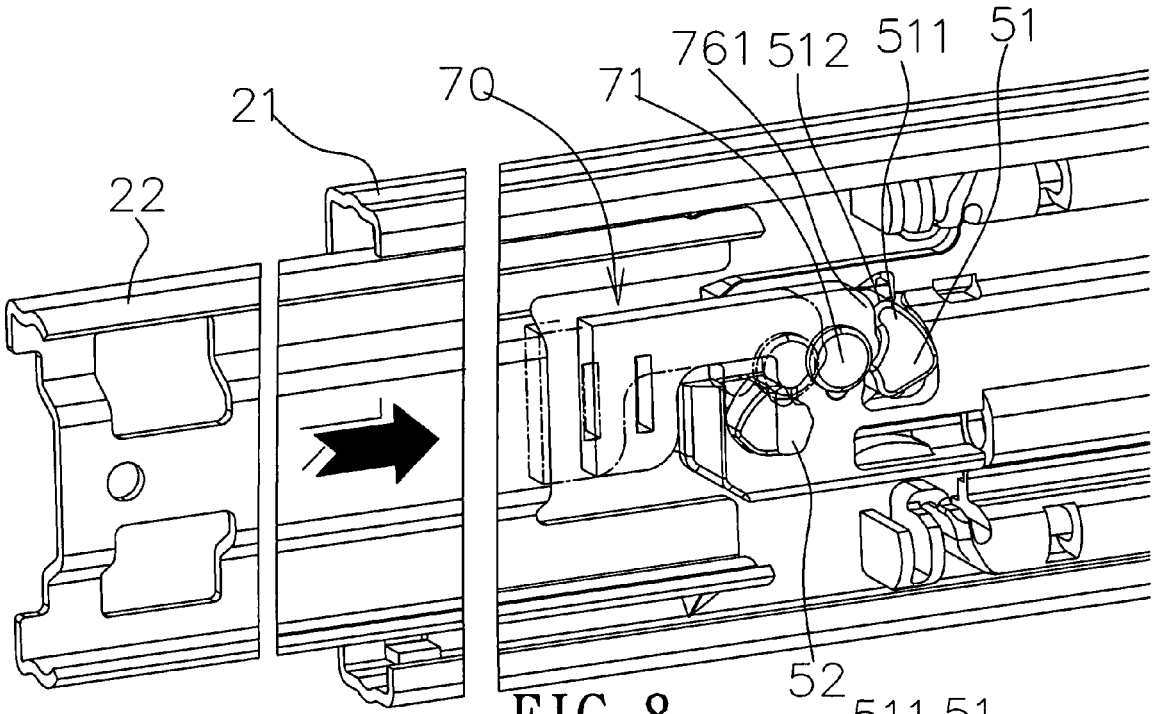
FIG. 8 is a schematic view of a rear-pushing operation of the present invention.
Figure 9:
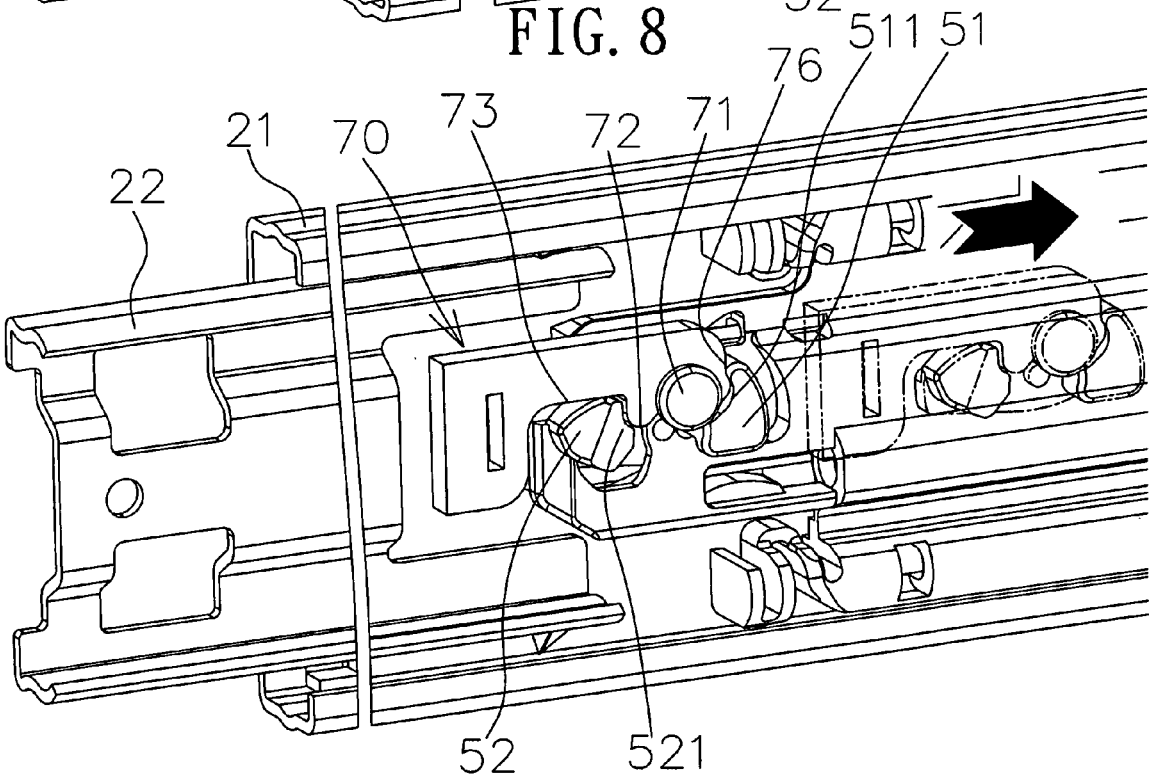
FIG. 9 is a second schematic view of a rear-pushing operation of the present invention.

With reference to FIGS. 7 and 7A, when the drawer or the cabinet is pushed and closed, the inner rail 23 and the middle rail 22 are driven by the drawer or the cabinet to move backward, and the link element 70 is moved backward accordingly. When the link element 70 touches the swing element 50, the link element 70 pushes the first actuating block 51 of the swing element 50 through the push-forward portion 761 to separate the first distal arc portion 512 from the latch groove 352 (as shown in FIGS. 8 and 9), and the guide slot 351 guides the swing element 50 to restore its position. Since the swing element 50 is released from the latch groove 352, the resilience of the spring 33 is applied onto the swing element 50 through the slide cover 41, such that the swing element 50 is linked by the slide cover 41 to move forward quickly. In the meantime, the swing element 50 will be latched and coupled by the second actuating block 52 and the arc press portion 72 of the link element 70. With the resilience of the spring 33, the link element 70 will produce a forward pulling force, for moving the inner rail 23 and the drawer or the cabinet backward. When the slide cover 41 is slid to resume its position at the distal base portion 32 of the control base 31, equilibrium is achieved to complete the function of automatically restoring the position of the drawer or the cabinet.

The present invention installs two springs and a shock absorbing device installed in the control device, and the dry rubber damping rod of the shock absorbing device is passively installed into the shock absorbing joint pipe of the shock absorbing slot protecting portion when the slide cover is moved forward and resumed its original position, a damping effect is formed when the dry rubber damping rod is sheathed with the shock absorbing joint pipe, and the resilience of the springs on both sides of the control base restores the shock absorbing device and the shock absorbing slot protecting portion slowly, gently and smoothly. The overall interactive operation of the control plate, the slide cover, the swing element and the link element provides the automatic position restoring function of the drawer or cabinet with a smooth, flexible and better operability, so as to enhance the applicability, practicality and competitiveness of the product.

In summation of the description above, the present invention complies with the requirements of patent application and thus is duly filed for patent application. While the invention has been described by means of specific embodiments, numerous modifications and variations could be made thereto by those skilled in the art without departing from the scope and spirit of the invention set forth in the claims.

What is claimed is:

1. An automatic position restoring slide rail device, comprising:

a slide rail device, including a bottom rail and an inner rail, and the inner rail being slid with respect to the bottom rail;

a control device, including a control base and a slide cover, and the control base being fixed at the bottom rail, and the control base having a shock absorbing device and at least one spring, and the shock absorbing device including a dry rubber damping rod, and the spring being coupled between the control base and the slide cover, and the control base having a control plate extended from the control base, a concave guide slot, and a latch groove disposed on a lateral side of a rear position of the guide slot and an aslant guide slot on another lateral side of the rear end of the latch groove, and the slide cover being slidably covered at the control base, and the slide cover being sheathed into a position corresponding to a shock absorbing joint pipe of the dry rubber damping rod, the slide cover having a first return slot at the front end and a second return slot at the rear end of the slide cover;

a swing element, pivotally coupled into the slide cover, and including a front end disposed at a first actuating block in the first return slot, a rear end disposed at a second actuating block in the second return slot, and an embedding portion disposed at the bottom of the swing element and embedded into the guide slot;

a link element, fixed at the inner rail, and having an arc press portion disposed on a lateral side of the link element, a lateral concave accommodating portion disposed at the rear end of the arc press portion, and a push-forward portion disposed at the front end of the link element.

2. The automatic position restoring slide rail device according to claim 1, further comprising a middle rail slidably disposed between the bottom rail and the inner rail.

3. The automatic position restoring slide rail device according to claim 1, wherein the slide cover comprises a pivoting hole disposed between the first return slot the second return slot, a pivotal rod portion disposed between the first actuating block and the second actuating block of the swing element and at a position corresponding to the pivoting hole.

4. The automatic position restoring slide rail device according to claim 1, wherein the first actuating block comprises a first concave press portion disposed at a rear end of the first actuating block and a first distal arc portion disposed on a side of the first actuating block.

5. The automatic position restoring slide rail device according to claim 1, wherein the second actuating block comprises a second concave press portion disposed at a front end of the second actuating block and a second distal arc portion disposed on a side of the second actuating block.

6. The automatic position restoring slide rail device according to claim 1, wherein the push-forward portion disposed at the front end of the link element comprises a protruding axle portion disposed at a rear end of the push-forward portion, and the inner rail comprises a positioning hole disposed at a position corresponding to the protruding axle portion.

7. The automatic position restoring slide rail device according to claim 1, wherein the inner rail comprises an adjusting hole, and the link element comprises an adjusting slot disposed at a position corresponding to the adjusting hole.

8. The automatic position restoring slide rail device according to claim 1, wherein the link element comprises a front protrusion disposed on a side of the push-forward portion.

9. The automatic position restoring slide rail device according to claim 1, wherein the bottom rail comprises a positioning element, and the rear end of the control plate comprises an abutting groove corresponding to the positioning element, and the control base comprises press plate disposed separately on both sides of the control base, a distal base portion disposed at the front end of the control base for coupling the bottom rail, and the a spring coupled to both sides of the shock absorbing device.

10. The automatic position restoring slide rail device according to claim 9, wherein the slide cover comprises two spring slot protecting portions and a shock absorbing slot protecting portion for installing the shock absorbing joint pipe, and the spring slot protecting portion comprises a front end disposed at an internal side of the spring slot for abutting a side press of the control base, a rear end for coupling a latch retreating portion of the spring, and a resilient press portion disposed at a rear end of the spring slot protecting portion rear end.

* * * * *